US008522662B2

(12) United States Patent
Presz, Jr. et al.

(10) Patent No.: US 8,522,662 B2
(45) Date of Patent: Sep. 3, 2013

(54) CONTROLLED-UNAIDED SURGE AND PURGE SUPPRESSORS FOR FIREARM MUZZLES

(75) Inventors: Walter M. Presz, Jr., Wilbraham, MA (US); Michael J. Werle, West Hartford, CT (US); Bart Lipkens, Hampden, MA (US); Jason Gawencki, Windsor, CT (US)

(73) Assignee: FloDesign, Inc., Wilbraham, MA (US)

( * ) Notice: Subject to any disclaimer, the term of this patent is extended or adjusted under 35 U.S.C. 154(b) by 564 days.

(21) Appl. No.: 12/652,287

(22) Filed: Jan. 5, 2010

(65) Prior Publication Data

US 2010/0163336 A1 Jul. 1, 2010

Related U.S. Application Data

(63) Continuation-in-part of application No. 12/212,166, filed on Sep. 17, 2008, now Pat. No. 8,322,266.

(60) Provisional application No. 60/994,280, filed on Sep. 18, 2007.

(51) Int. Cl.
*F41A 21/00* (2006.01)

(52) U.S. Cl.
USPC ..... 89/14.3; 181/223

(58) Field of Classification Search
USPC ..... 89/14.2, 14.3, 14.4; 42/79; 181/223
See application file for complete search history.

(56) References Cited

U.S. PATENT DOCUMENTS

| | | | | |
|---|---|---|---|---|
| 1,017,003 | A | 2/1912 | Kenney | |
| 1,860,276 | A | 5/1932 | De Luce et al. | |
| 2,636,563 | A | 11/1944 | Vinson | |
| 4,291,610 | A | 9/1981 | Waiser | |
| 4,459,895 | A * | 7/1984 | Mazzanti | 89/14.3 |
| 5,761,900 | A | 6/1998 | Presz, Jr. | |
| 6,308,609 | B1 | 10/2001 | Davies | |
| 6,948,415 | B2 * | 9/2005 | Matthews et al. | 89/14.4 |
| 7,073,426 | B1 * | 7/2006 | White | 89/14.4 |
| 7,237,467 | B1 | 7/2007 | Melton | |
| 7,308,967 | B1 | 12/2007 | Hoel | |
| 7,931,118 | B1 * | 4/2011 | Cronhelm | 181/223 |
| 2007/0107590 | A1 * | 5/2007 | Silvers | 89/14.4 |
| 2007/0266844 | A1 * | 11/2007 | Dueck | 89/14.4 |

FOREIGN PATENT DOCUMENTS

| | | |
|---|---|---|
| FR | 825016 | 2/1938 |
| FR | 981869 | 5/1951 |
| WO | WO 83/01680 | 5/1983 |
| WO | WO 99/27317 | 3/1999 |

* cited by examiner

*Primary Examiner* — Gabriel Klein
(74) *Attorney, Agent, or Firm* — Richard M. Klein; Fay Sharpe LLP

(57) ABSTRACT

A Controlled Unaided Surge and Purge Suppressor for firearms uses the blast and plume characteristics inherent to the ballistic discharge process to develop a new two-step controlled surge and purge system centered around advanced mixer-ejector concepts. The blast surge noise is reduced by controlling the flow expansion, and the flash effects are reduced by controlling inflow and outflow gas purges. This is a C-I-P application. In the preferred C-I-P embodiment, the blast surge is mitigated via a slotted mixer nozzle; a first expansion chamber; a generally "wagon-wheel" shaped blast baffle with a vent hole; a series of alternating baffles, with vent holes, strategically located along the suppressor's inner wall surface; a second expansion chamber; and an exit opening. This preferred C-I-P embodiment contains no "outside" vent holes (i.e., throughbores) which extend through the suppressor's outer or longitudinal wall. Instead of ingesting ambient air through such throughbores and mixing that air with the muzzle gases, as shown in the parent application, the preferred C-I-P embodiment ingests and mixes chamber gases and contaminants with the muzzle gases while allowing fluid flow through and out the suppressor. It too though can control or eliminate the Mach disk.

16 Claims, 18 Drawing Sheets

CONTROLLED-UNAIDED SURGE AND PURGE SUPPRESSORS FOR FIREARM MUZZLES

This is a continuation-in-part ("C-I-P") application of U.S. Utility patent application Ser. No. 12/212,166, filed Sep. 17, 2008 now U.S. Pat. No. 8,322,266 ("Parent Application"), which was based upon a U.S. Provisional Patent Application, Ser. No. 60/994,280, filed Sep. 18, 2007.

FIELD OF INVENTION

The present invention deals generally with firearms. More particularly, it deals with noise and flash suppressors for firearm muzzles.

BACKGROUND OF INVENTION

Reducing muzzle noise and flash from military and security personnel firearms (e.g., long guns and pistols) provide a significant tactical advantage in the field. Existing suppression technology reduces noise and flash, but comparatively little science exists to explain how current designs can be modified or replaced to provide enhanced suppressor performance, including the useful life span of the suppressor. Furthermore, even less design guidance exists that can lead to integration of suppressors into a firearm's barrel assembly. Lessons learned as a result of the ongoing military and homeland security based conflicts have indicated that increased use of current suppressors, as part of everyday operations, have led to shortened life cycles of suppressors, increased maintenance (and sometimes damage) of weapons, and considerable variability in weapon accuracy.

To set the stage for developing improved suppressors, it is necessary first to identify the critical elements of the attendant flow fields as thoroughly documented in Klingenberg, Firearmter and Heimerl, Joseph M., Firearm Muzzle Blast and Flash, AIAA Progress in Astronautics and Aeronautics, Volume 139, 1992. See the copy of in Applicants' Information Disclosure Statement.

These characteristics can be broken down into three core elements. The first two core elements are: the precursor blast; and a main blast set up by the expanding gases. The precursor blast consists of mostly air with a small amount of propellant and the main blast is made up of spherical pressure waves that quickly overtake the fired projectile. Both of these blasts are sources of low frequency noise that carry very far distances. The third core element is the highly visible gas flash which follows the blast.

In general, a gas flash occurs because air mixes with the fuel rich propellants and the high temperatures from the blast waves. The result of this mixture forms a gas flash which is greatly increased in the secondary flow region that occurs away from the muzzle of a firearm.

When a gas flash forms, it occurs in three parts: primary, intermediate, and secondary flashes. The primary flash forms at the muzzle in the supersonic flow region and is very small. An intermediate flash occurs directly behind the projectile, but in front of the Mach disk leading any supersonic flow region. (Not all firearms have supersonic discharge flows.) The secondary flash is the most severe, and it occurs downstream of the firearm muzzle, and after the normal shock resulting from the muzzle gas over-expansion. The large flash seen when firing a projectile is actually the secondary flash.

With an understanding of the three core elements involved in the blast and flash from a projectile, the individual components can be analyzed to assess their critical components.

Considering the principal characteristics of the blast wave, co-Applicants (from the Parent Application) have found that it is essentially a spherical blast wave that travels rapidly but also decays rapidly both strength-wise and time/distance-wise. Relative to the flow-field attendant to the flash, it establishes after or behind the main blast wave with a structure very similar to that of a traditional under-expanded jet plume often seen in propulsion applications. The key elements of the post-blast wave flow field are the free jet boundary and the highly under-expanded jet flow region all flowing strongly in the downstream axial direction. The over-expanded gas results in the normal shock or Mach disk, which causes the secondary flash and a significant portion of the noise. The important point is that the key physics of this type of flow structure is common in propulsion aerodynamics, and can be used to generate performance correlations for use in developing more efficient suppressor designs.

There are a wide range of firearm suppressor designs. See, for example, the Prior Art shown in FIG. 1 of the present application. All current designs apparently have three recurrent features: (i) a circular or near circular cross-section with a diameter approximately five times the firearm's muzzle diameter; (ii) a solid outer surface so no gases can enter or escape the suppressor except through its entrance and exit ports; and (iii) complex flow nozzles, baffles and/or chambers interior to the suppressor for capturing the muzzle gases and mitigating the blast over-pressure level.

An alternate means of controlling supersonic flows, originally developed for propulsion applications, involves the use of flow mixer-ejectors, as discussed in U.S. Pat. No. 5,884,472 to Walter M. Presz, Jr. and Gary Reynolds. Ejectors are well-known and documented fluid jet pumps that draw flow into a system and thereby increase the flow rate through that system. Mixer/ejectors are short compact versions of such jet pumps that are relatively insensitive to incoming flow conditions and have been used extensively in high-speed jet propulsion applications involving flow velocities near or above the speed of sound. See, for example, U.S. Pat. No. 5,761,900 to Walter M. Presz, Jr., which also uses a mixer downstream of a gas turbine nozzle to increase thrust while reducing noise from the discharge. Dr. Presz is a co-inventor in the present application. An ejector is a fluid dynamic pump with no moving parts.

Ejectors use viscous forces to lower the velocity and energy of a jet stream by ingesting lower energy flow which can lead to flow characteristics that may augment thrust, cool exhaust gases, suppress jet infrared signature, and importantly to ballistic applications, reduce attendant noise and flash. Mixers improve the performance characteristics of ejectors by inducing stiffing, or axial vortices, that promote rapid mixing of the high velocity primary jet with the cooler, and sometimes heavier, ingested gas; thus resulting in more compact devices. Numerous patented products have derived from this concept. The mixer/ejector concept is well accepted within the aviation and jet propulsion community as an extremely efficient solution to aircraft noise and exhaust temperature suppression.

Gas turbine technology has yet to be applied successfully to firearm muzzle suppressors. If one were to replace an under-expanded jet engine exhaust for a ballistic blast from a firearm, mixing and ejecting the hot gases expelled with the projectile over the length of the barrel, it may be seen that such a technology could significantly reduce noise, flash, and provide outside air to the barrel that could be employed to cool and clean the suppressor components.

Accordingly, it is a primary objective of the present invention to provide a firearm suppressor that employs advanced fluid dynamic ejector pump principles to consistently deliver levels of noise and flash suppressor equal to or better than current suppressors.

It is another primary objective to provide an improved firearm suppressor with significantly increased useful life span over that of current firearm suppressors.

It is another primary objective to provide a self-cleaning, self-cooling firearm suppressor using mixer/ejector technology.

It is another primary objective to provide an improved firearm suppressor using mixer/ejector technology to control the muzzle blast wave and overexpansion flow for better suppression.

It is another object, commensurate with the above-listed objects, to provide an improved suppressor which is durable and safe to use.

SUMMARY OF INVENTION

The Parent Application dealt with pre-production embodiments shown herein as FIGS. 2A-10. This C-I-P application deals with two improved embodiments shown in FIGS. 11-15. The C-I-P embodiment, shown in FIGS. 11-12, is now the preferred embodiment.

Applicants have developed an improved firearm suppressor through the use of advanced mixer/ejector concepts. By recognizing and analyzing the blast and plume characteristics, inherent in ballistic discharges, Applicants have created a new two-step controlled unaided surge and purge system (nicknamed "CUSPS") for firearm suppressors.

This new "CUSPS" approach attends to the blast surge effects by controlling the flow expansion into the suppressor, and attends to the flash effects by controlling inflow and outflow gas purging. The "CUSPS" rapidly reduces the pressure energy associated with a firearm muzzle blast before it exits the suppressor, thereby reducing noise and muzzle flash.

In the preferred C-I-P embodiment, the blast surge is mitigated via a rapid, divergent nozzle volume increase, created sequentially by: an inlet slotted mixer nozzle; a first expansion chamber; a blast baffle resembling a "wagon wheel"; a series of alternating baffles, with vent holes, strategically located along the suppressor's inner wall surface; and a second expansion chambers.

In the alternate C-I-P embodiment, a differently shaped blast baffle is angled or pitched forward.

Note that the two C-I-P embodiments contain no "outside" vent holes which extend through the suppressor housing's outer wall (i.e., throughbores). Instead of ingesting ambient air through such vent holes and mixing that air with the muzzle gases, as shown in the parent application, the C-I-P embodiments have different structures and work in a different manner. They too though can control or eliminate the Mach disk.

Based upon preliminary testing, Applicants believe that their C-I-P embodiments will generate the following benefits: lower noise; hide or eliminates flash; integrate cooling and self-cleaning; and maintain firearm accuracy at longer distances.

DETAILED DESCRIPTION OF PREFERRED EMBODIMENTS

Figure 1A:
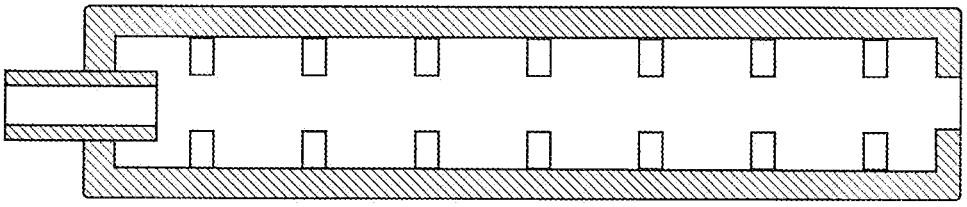
FIG. 1A (Prior Art)
FIG. 1, labeled "Prior Art", illustrates four examples of prior firearm suppressors.
Figure 1B:
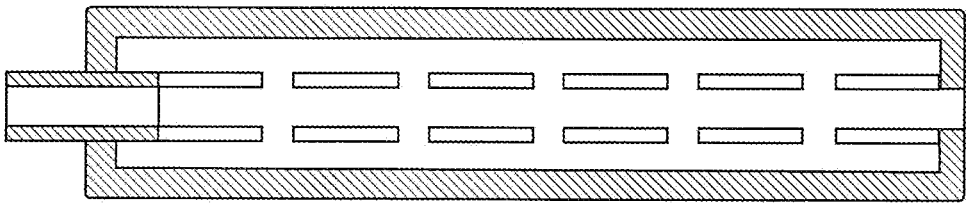
FIG. 1B (Prior Art)
Figure 1C:
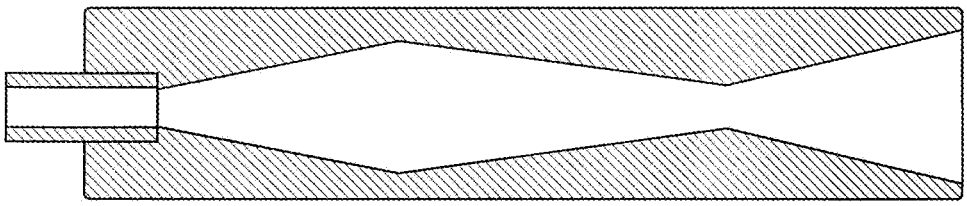
FIG. 1C (Prior Art)
Figure 1D:
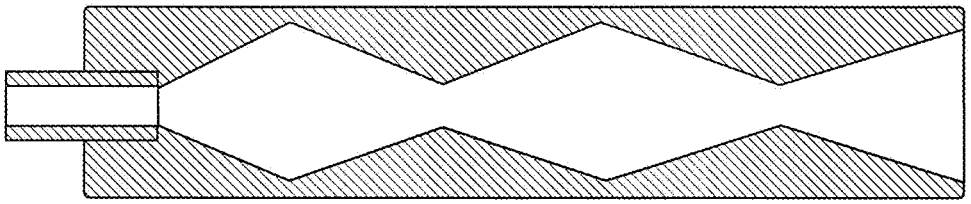
FIG. 1D (Prior Art)

Referring to the drawings in detail, FIGS. 2A-10 show alternate pre-production embodiments (from the Parent Application) of the "CUSPS" suppressor for firearms. Those prior embodiments are described below for ease of reference. Like elements in the drawings sometimes use the same element numbers.

Figure 11:
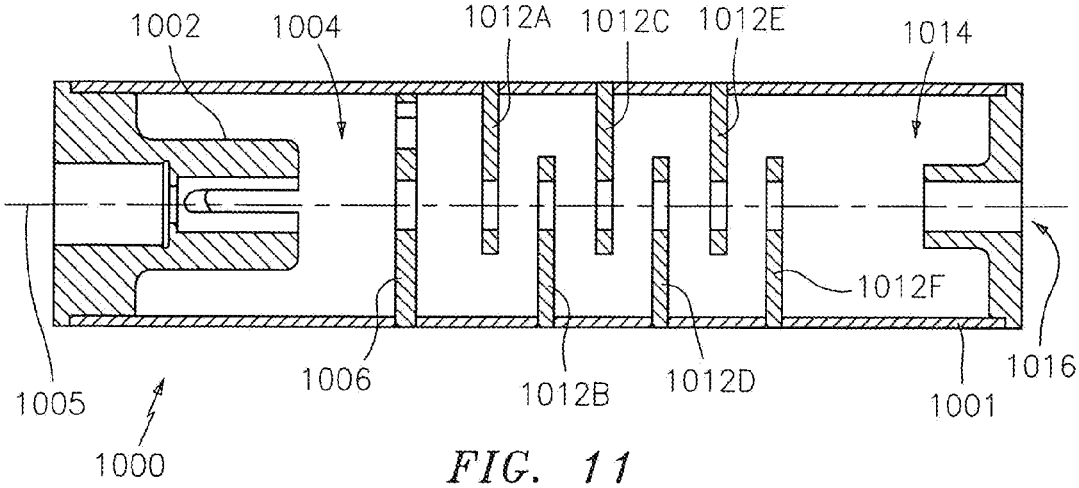
FIG. 11 is a cross-sectional side view of Applicants' preferred C-I-P embodiment.
Figure 12:
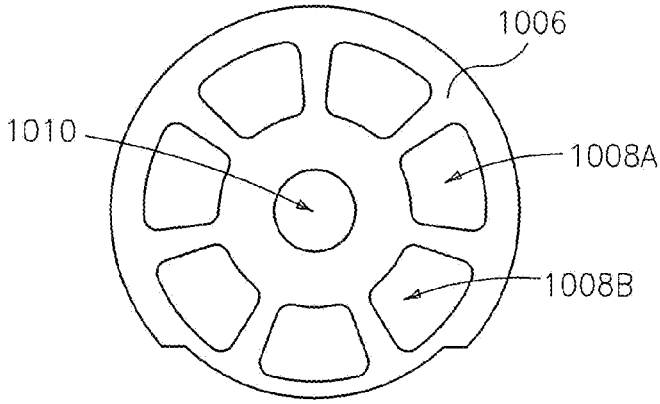
FIG. 12 is a perspective view of the FIG. 11 embodiment.
Figure 13:
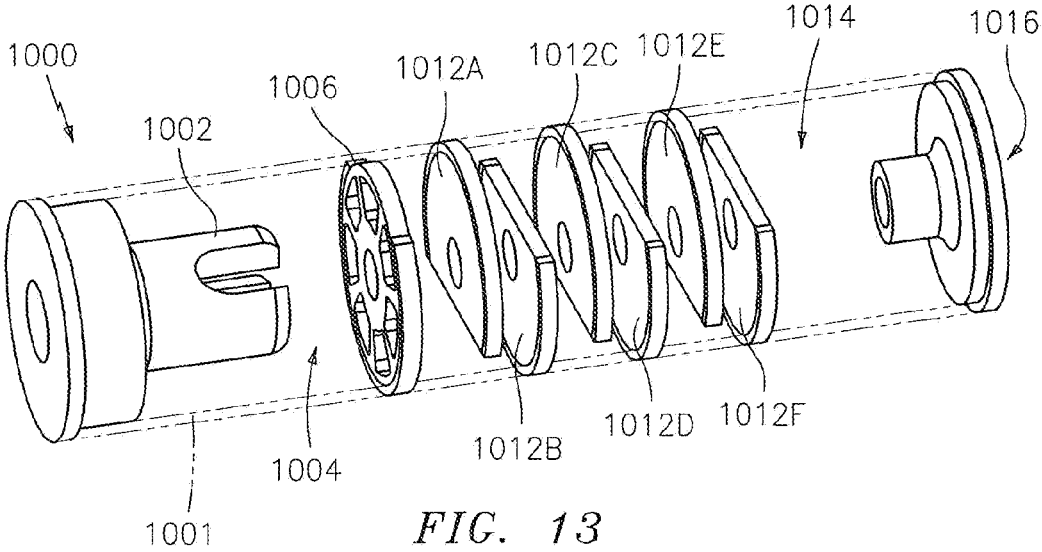
FIG. 13 is a front plan view of a blast baffle of the FIG. 11 embodiment.

This C-I-P application adds and discloses the near-production model shown in FIGS. 11-13. That is the preferred embodiment in this application. It also depicts an alternate embodiment shown in FIGS. 14-15.

In the prior embodiment 100 (see FIG. 8A), from the parent application, the "CUSPS" is a detachable firearm suppressor comprising:

a. a tubular housing 102, removably affixed to and axially aligned with the muzzle end of a firearm barrel 103, wherein the housing 102 has vent openings 104 radially and longitudinally distributed in its outer surface or wall, and the housing 102 contains:
   i. a projectile entrance port 105, adjacent the terminus, that allows the blast wave and exit gas from a discharged firearm to expand inside the housing 102;
   ii. a projectile exit port 114 and internal support structure at its terminus; and
   iii. a one-stage mixer/ejector in an expansion chamber 113, comprising a lobed mixer nozzle 116 at the projectile entrance location 105 and the vent holes 104 which act as the ejector, wherein the mixer/ejector is adapted in size and shape to use the kinetic energy of the firearm's exit gases to pump external or ambient air in and through the suppressor vent holes 104 for cooling and/or cleaning the suppressor (and to a lesser degree cool the gun's muzzle end), and wherein contours of internal lobes for the mixer and ejector interact within the tubular housing 102 to mix ingested ambient air, drawn in through the vent holes 104, with the firearm's exit gases to reduce firearm noise and flash;
   iv. wherein the expansion chamber 113 allows the mixed and pumped air and firearm's exit gases to expand within the chamber to increase pressure loss and reduce noise;
   v. a round divergent nozzle 122, at the projectile entrance port 105, having a divergent area (at 123) distribution adapted in size and shape to reduce flow over-expansion and shock formation, thus reducing flash; and
   vi. a convergent-divergent diffuser 124, or alternately (though not preferred) a contoured nozzle at the suppressor exit 125 to maximize ejector pumping efficiencies; and
   vii. an exit hole 125 in the housing which is significantly larger than the bore (i.e., hole) 126 of the barrel.

The prior embodiment 100 (see FIG. 8A) also includes a second-stage mixer/ejector system comprising: a lobed mixer nozzle 127 in the entrance of a second expansion chamber 128; and a lobed ejector nozzle 129 which surrounds an end of the lobed mixer nozzle 127 and extends downstream into the second chamber 128.

Though not shown, the vent holes 104 are preferably convergent. They narrow towards the outside of the suppressor.

Figure 2A:
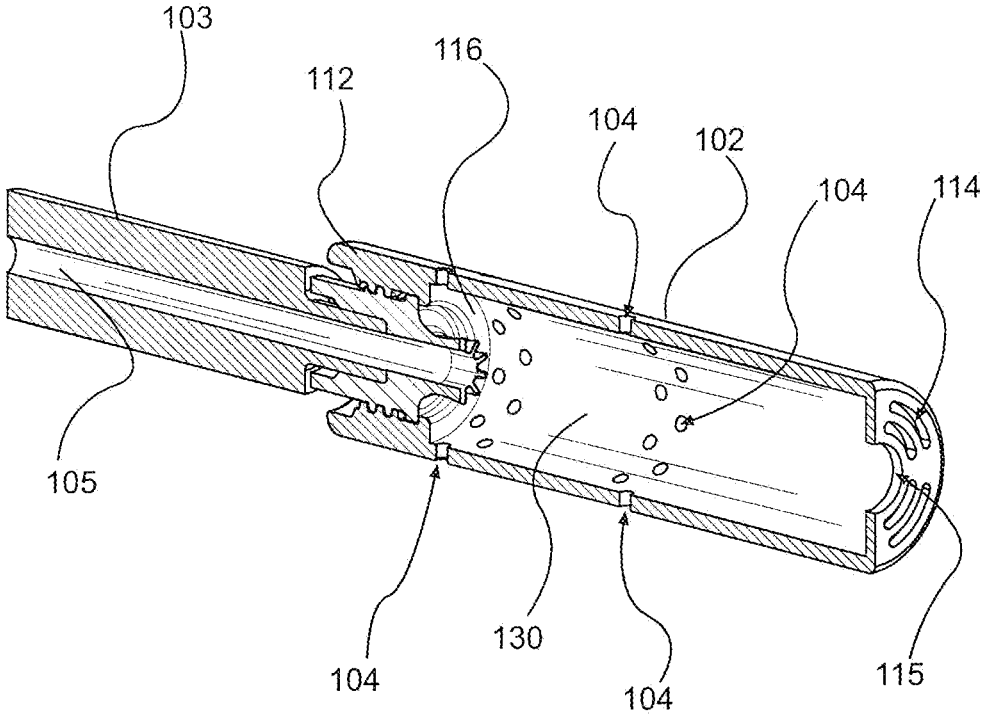
FIG. 2A is a perspective view, with portions broken away and removed, of a an alternate embodiment of a "CUSPS" suppressor (from the Parent Application) having a housing, a lobed mixer nozzle at a projectile entrance location, a "straight" expansion chamber inside the housing, and vent openings or holes distributed in the housing.
Figure 2B:
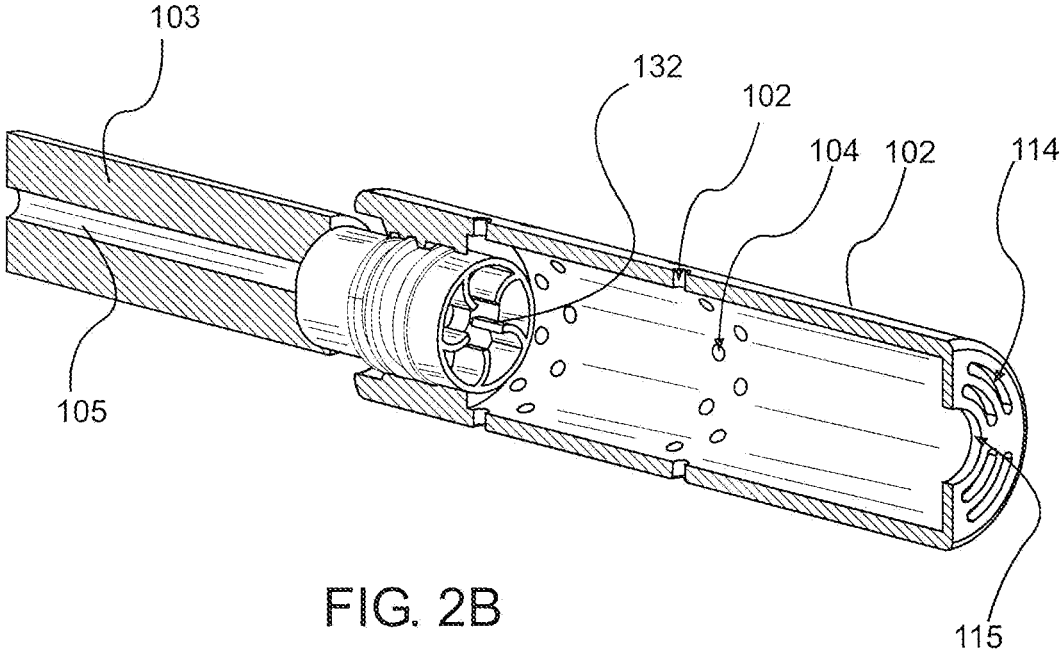
FIG. 2B is a perspective view, with portions broken away, of another alternate embodiment of a "CUSPS" suppressor (from the Parent Application) with a swirl nozzle at the projectile entrance location instead of the lobed nozzle of FIG. 2A.

FIG. 2A depicts an alternate embodiment of a "CUSPS" suppressor, from the Parent Application, having: a housing 102, a lobed mixer nozzle 116 at a projectile entrance location, a "straight" expansion chamber 130 with a constant diameter inside the housing, and vent openings or holes 104 distributed in the housing;

FIG. 2B depicts an alternate embodiment of a "CUSPS" suppressor, from the Parent Application, with a swirl nozzle 132 at the projectile entrance location, instead of a lobed nozzle, and vent holes 104 distributed in the housing 102.

Figure 2C:
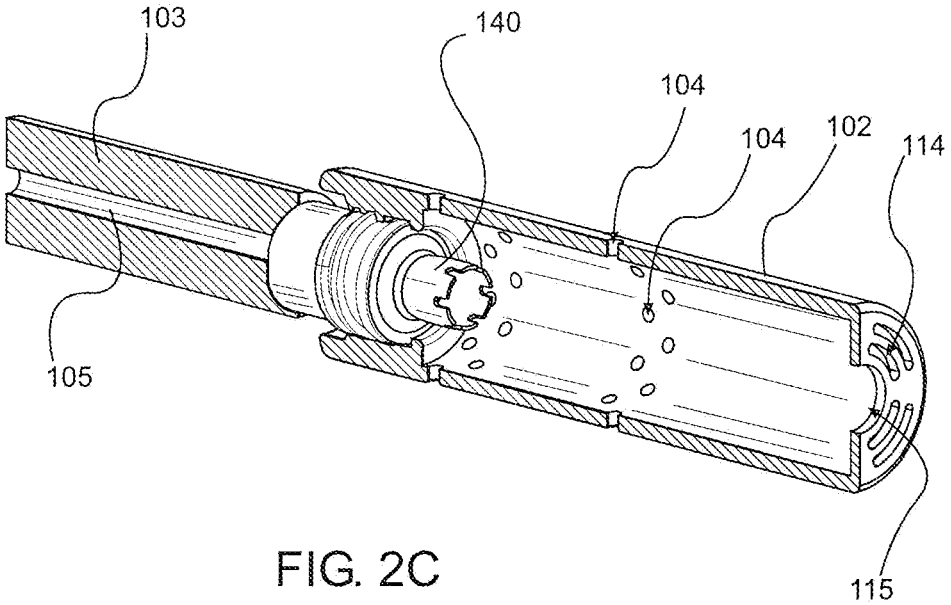
FIG. 2C is a perspective view, with portions broken away, of another embodiment of a "CUSPS" suppressor (from the Parent Application) with a slotted nozzle at the projectile entrance location instead of a swirl nozzle or a lobed nozzle.
Figure 3:
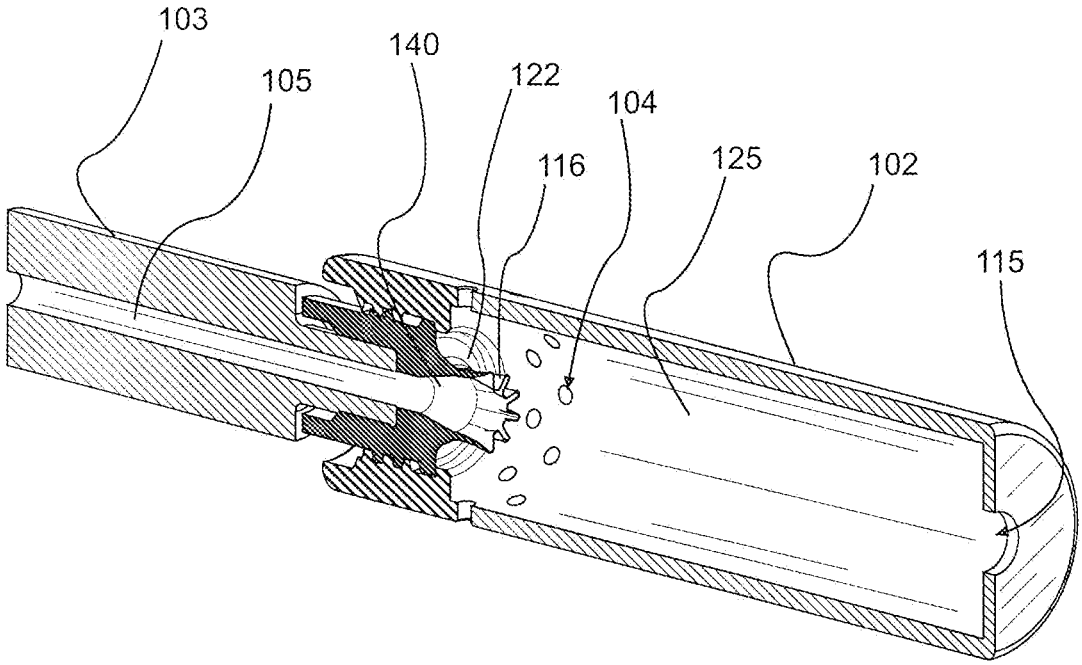
FIG. 3 is a perspective view, with portions broken away, of another alternate embodiment of a "CUSPS" suppressor (from the Parent Application) showing a divergent round nozzle at the projectile entrance location before the entrance lobed nozzle, and a single-stage ejector formed by the vent openings distributed on the suppressor outer surface.

FIG. 2C depicts another embodiment of a "CUSPS" suppressor, from the Parent Application, with a slotted nozzle 140 at the projectile entrance location, instead of a swirl nozzle 126 or a lobed nozzle 116, and vent holes 104 distributed in the housing 102.

Figure 4:
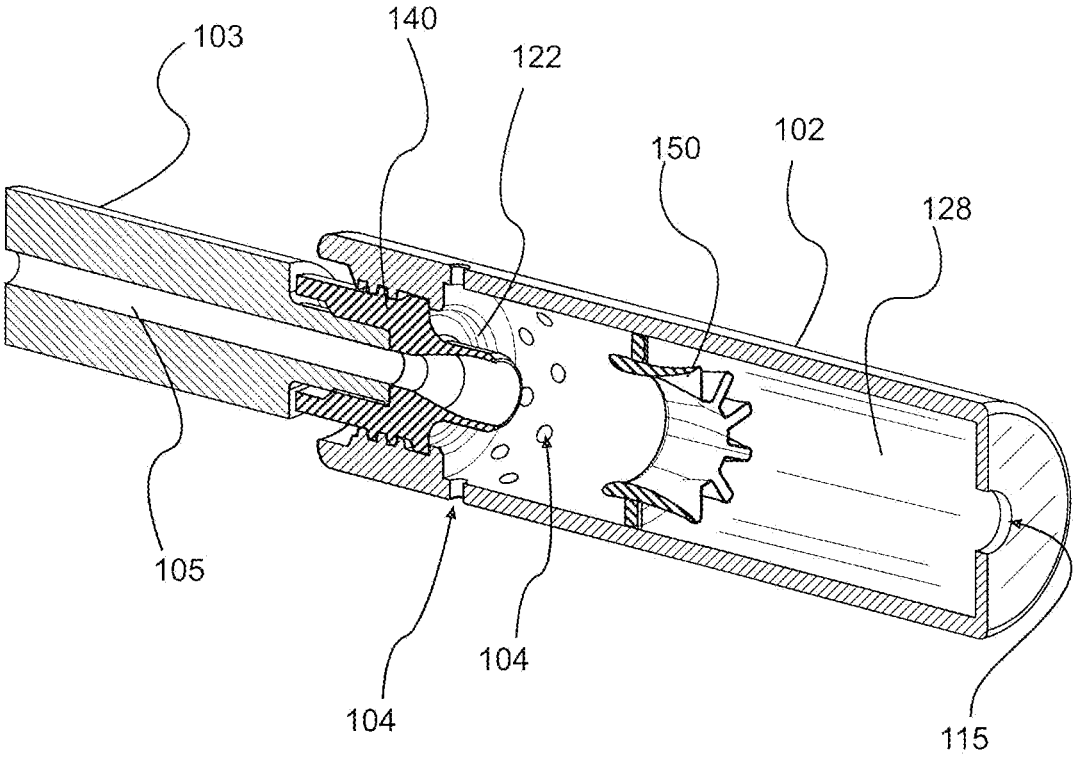
FIG. 4 is a perspective view, with portions broken away, of another alternate embodiment of a "CUSPS" suppressor (from the Parent Application) with a mixer shroud system detached from a divergent round entrance nozzle forming a two-stage ejector.
Figure 5A:
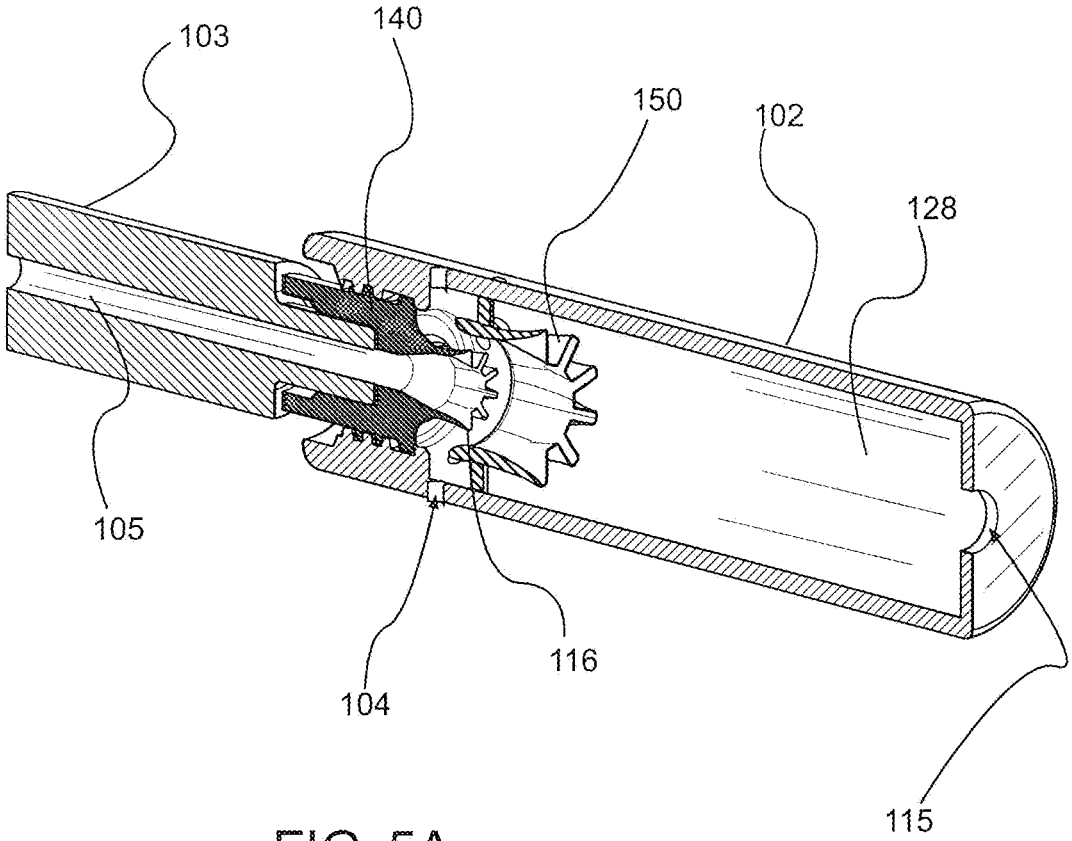
FIG. 5A is a perspective view, with portions broken away, of another alternate embodiment of a "CUSPS" suppressor (from the Parent Application) with a mixer shroud system detached from an entrance mixer nozzle forming a two-stage mixer/ejector.
Figure 5B:
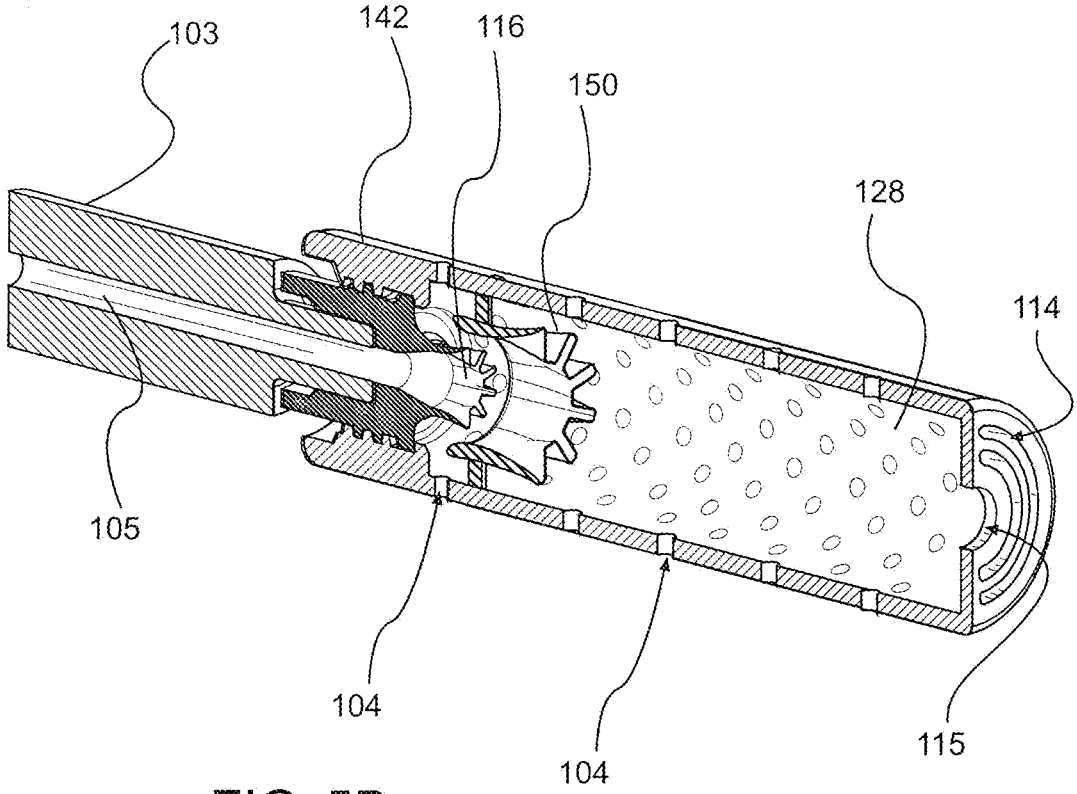
FIG. 5B (from the Parent Application) shows the same two-stage mixer/ejector system of FIG. 5A, but with vent holes added to the exit port location of the suppressor.
Figure 6:
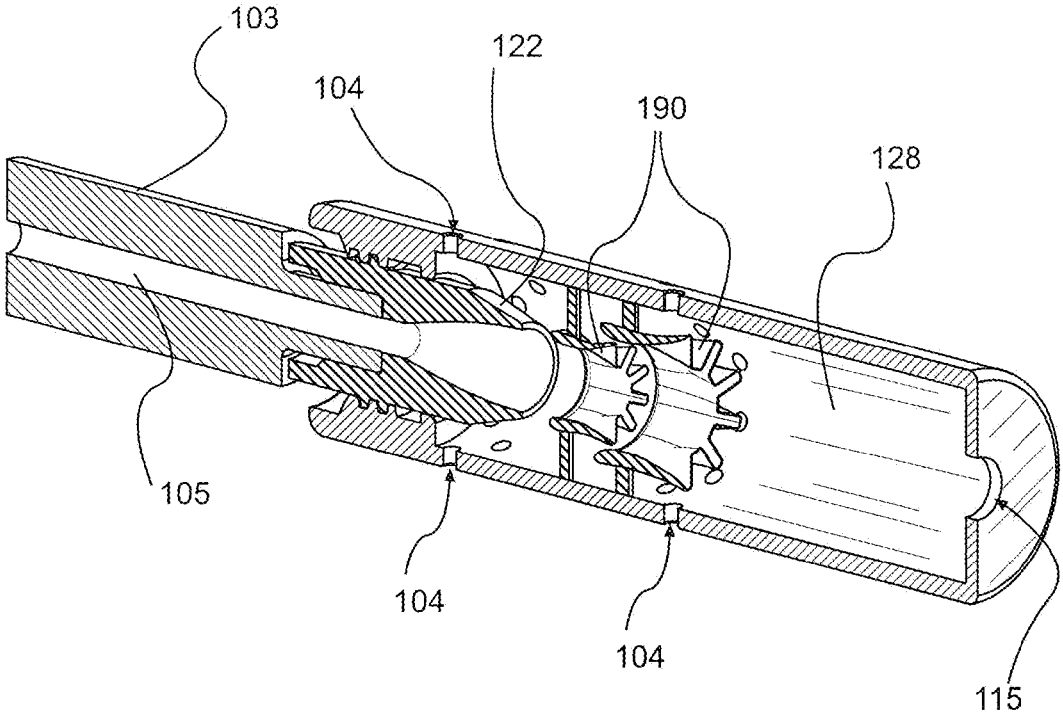
FIG. 6 is a perspective view, with portions broken away, of another alternate embodiment of a "CUSPS" suppressor (from the Parent Application) with a mixer/ejector system detached from the divergent entrance nozzle forming a three-stage ejector system.

FIG. 4 depicts another alternate embodiment of a "CUSPS" suppressor, from the Parent Application, with a mixer shroud system 150, detached from a divergent round entrance nozzle 152, forming a two-stage ejector using vent openings 104 for the ejector distributed in the housing 102;

FIG. 5A depicts another alternate embodiment of a "CUSPS" suppressor, from the Parent Application, with a mixer shroud system 150 detached from an entrance mixer nozzle 116, forming a two-stage mixer/ejector system 180, and vent openings 104 for the ejector distributed in the housing 102;

FIG. 5B shows the same two-stage mixer/ejector system 180 of FIG. 5A, but with a lobed nozzle 116 and vent holes 104 added to the exit port location 182 of the suppressor;

FIG. 6 depicts another alternate embodiment of a "CUSPS" suppressor, from the Parent Application. This embodiment includes a mixer/ejector system 190 detached from the divergent entrance nozzle 152 forming a three-stage ejector system, and vent openings 104 for the ejector 192 distributed in the housing 102.

Figure 7:
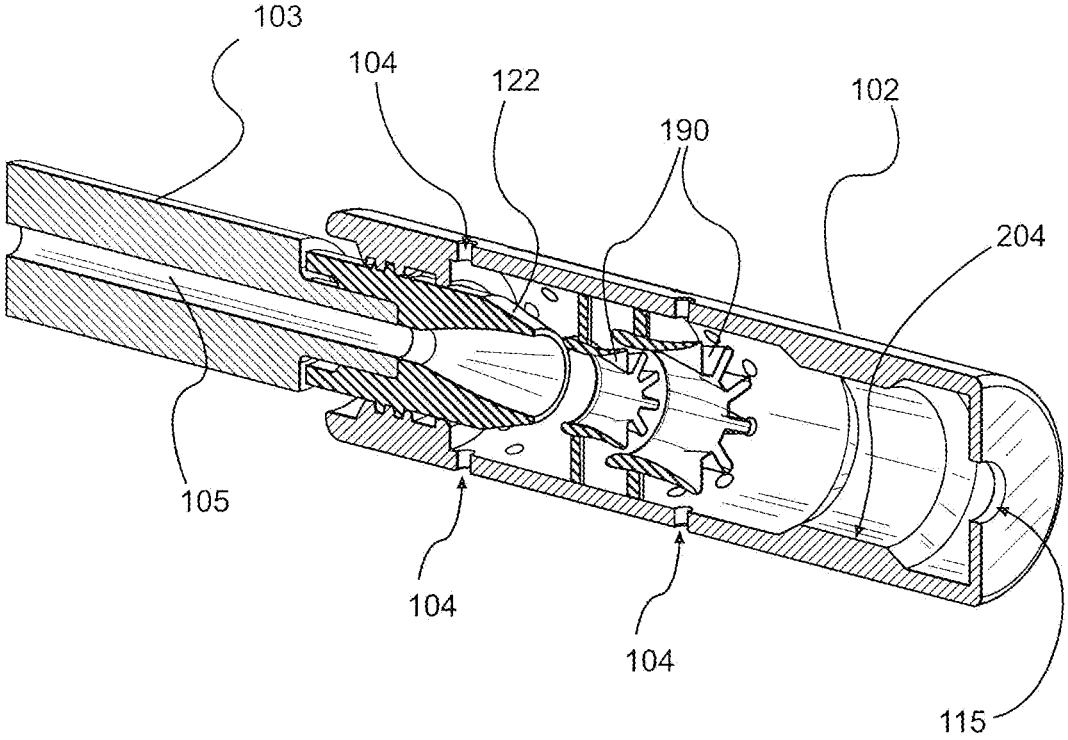
FIG. 7 is a perspective view, with portions broken away, of another alternate embodiment of a "CUSPS" suppressor (from the Parent Application) with a mixer/ejector system detached from the divergent entrance nozzle, forming a three-stage ejector system, and a convergent-divergent supersonic diffuser in an expansion chamber of the suppressor.

FIG. 7 depicts an alternate embodiment of a "CUSPS" suppressor, from the Parent Application, with a mixer/ejector system 200 detached from the divergent entrance nozzle 152, forming a three-stage ejector system, vent openings 104 for the ejector 202 distributed in the housing's outer wall, and a convergent-divergent supersonic diffuser 204 in the expansion chamber 206 of the suppressor.

Figure 8A:
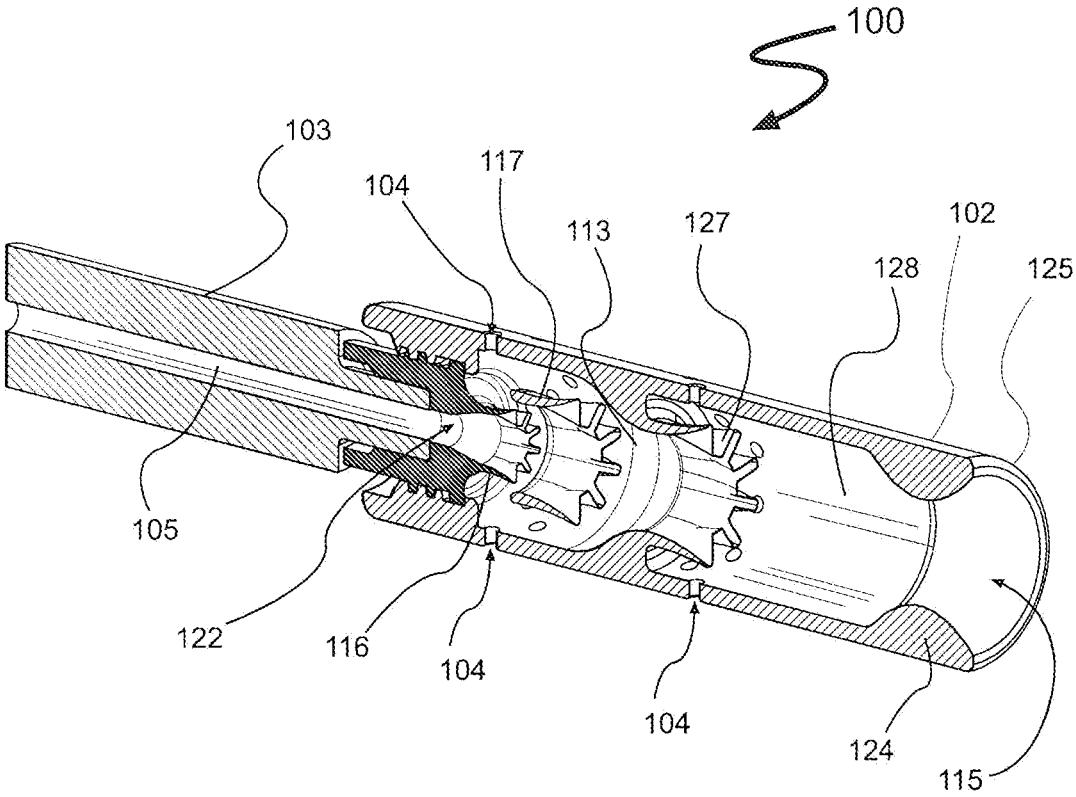
FIG. 8A shows a perspective views, with portions broken away, of a previously preferred "CUSPS" embodiment (from the Parent Application): a detachable suppressor with two expansion chambers; a first-stage mixer/ejector comprising a lobed nozzle and vent holes at the entrance to the suppressor, which are in the first expansion chamber; a second-stage mixer/ejector system comprising a lobed nozzle in the entrance of the second expansion chamber and an lobed ejector nozzle which extends into the second chamber; and a convergent-divergent diffuser as part of the suppressor exit port.
Figure 8B:
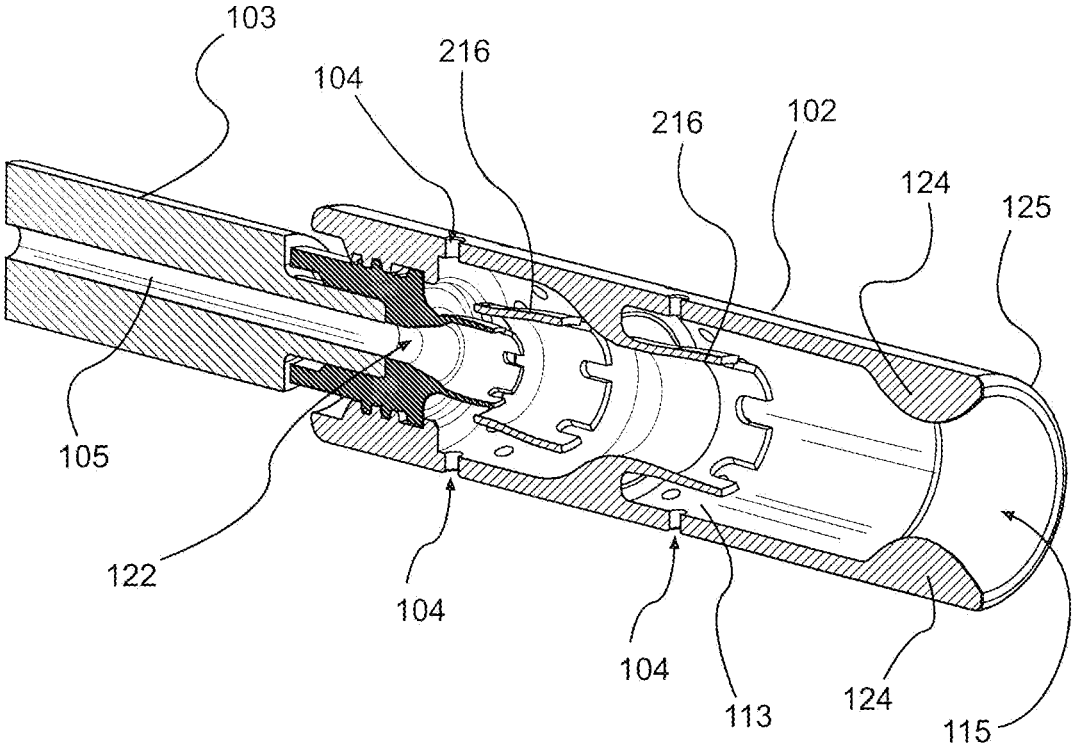
FIG. 8B shows the same system, as in FIG. 8A, but with slotted nozzles replacing the lobed nozzle.
Figure 8C:
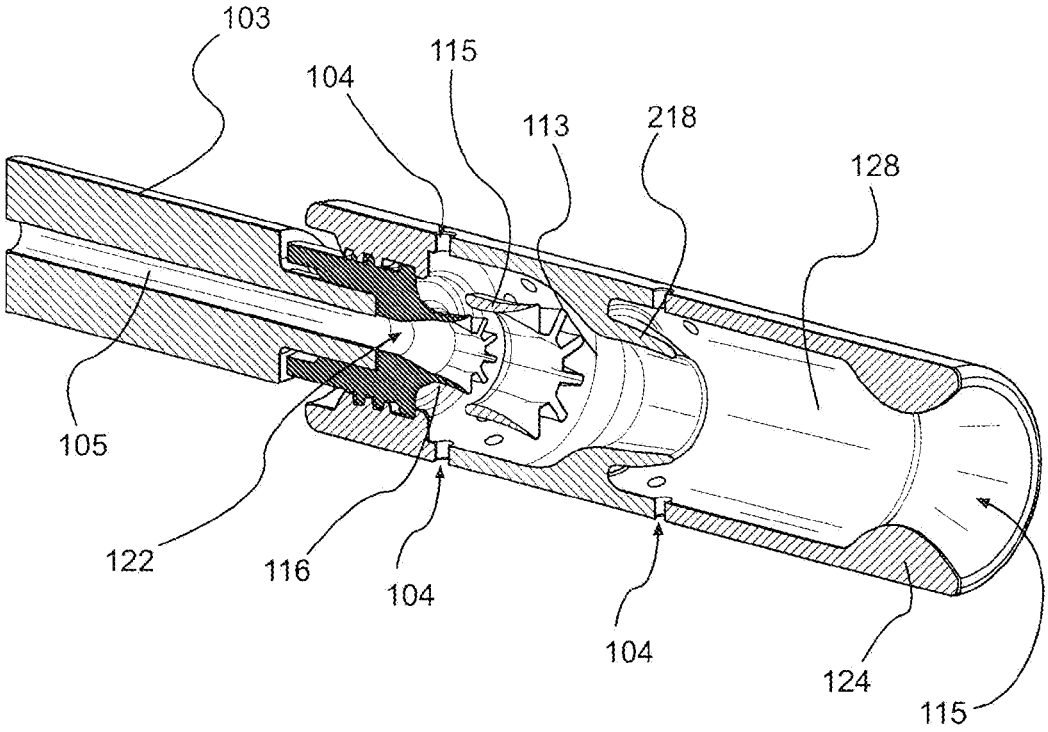
FIG. 8C shows the same system, as in FIG. 8B, but with a round convergent nozzle at the entrance of the second expansion chamber.
Figure 9:
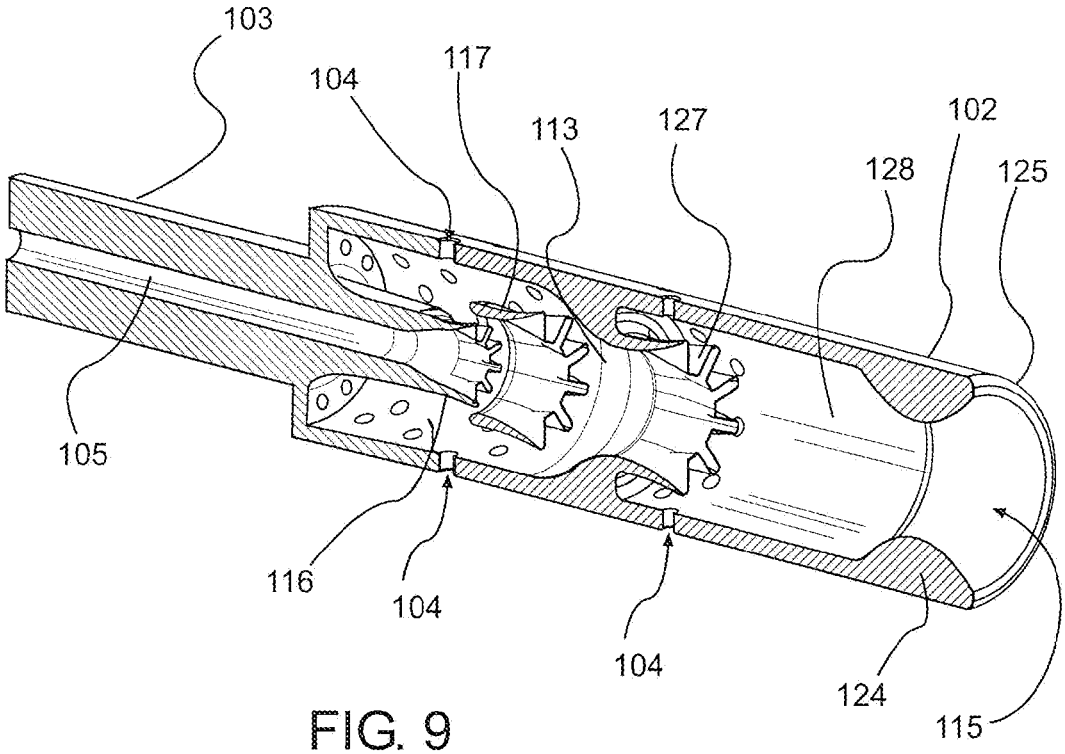
FIG. 9 shows an integrated barrel "CUSPS" with ejector vent holes before the barrel exit and surrounding the barrel.
Figure 10A:
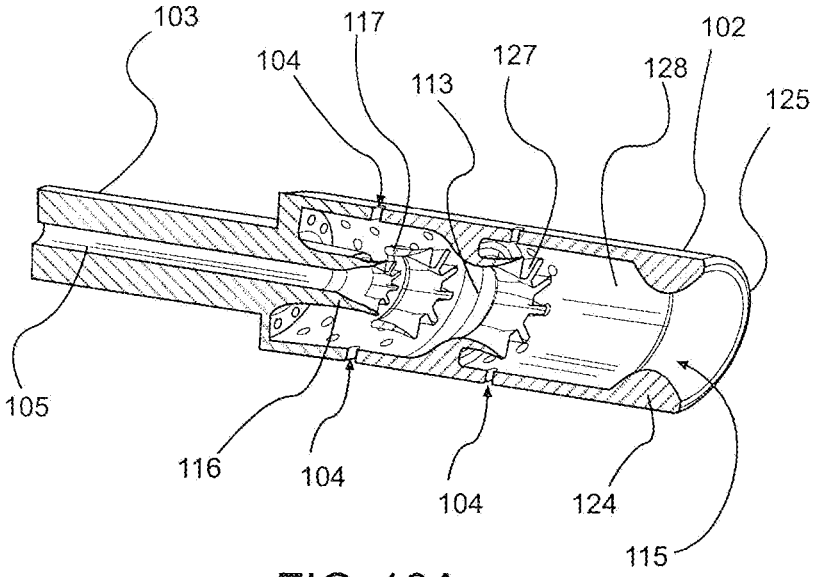
FIG. 10 shows an integrated barrel "CUSPS" having a different shaped housing.
Figure 10B:
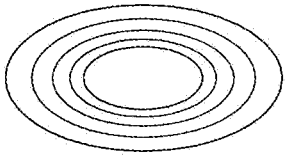

FIGS. 8B and 8C depict additional embodiments of "CUSPS" suppressors, from the Parent Application, in which: FIG. 8B shows the same system, as in FIG. 8A, but with slotted nozzles 216 replacing the lobed nozzles 116; and FIG. 8C shows the same system, as in FIG. 8B, but with a round convergent nozzle 218 at the entrance of the second expansion chamber 128;

FIG. 9 shows an integrated barrel "CUSPS" suppressor, from the Parent Application, with ejector vent holes 104 before the barrel exit and surrounding the barrel 103; and FIG. 10 shows an integrated barrel "CUSPS" suppressor, from the Parent Application, having a different shaped housing.

While the depicted "CUSPS" suppressor 100 has lobed internal nozzles 116, it could instead have slotted rounded internal nozzles. Both types have divergent area distributions to minimize flow overexpansion and reduce noise and flash.

Tubular housing 102 need not be circular in cross section. Its major axis is preferably horizontal (i.e., co-axial with the firearm barrel 103; or, alternatively vertical (not shown) or in between (not shown).

Experimental and analytical analyses of the "CUSPS" embodiment 100 indicates: the "CUSPS" can reduce the noise induced by the firearm's muzzle blast wave, reduce the radiant flash caused by the propellant gases and ingest ambient air to both cool the suppressor and purge it of residual gases, thereby increasing its useful life span.

Based on their experimental and analytical results, and the observation that the vent holes permits easier flushing of the interior volume with cleaning fluids, the Applicants believe the "CUSPS" embodiment 100 will reduce the blast wave induced noise at three feet from the muzzle exit by 20 db or more, make the gas flash visually undetectable to an observer at any distance greater than 1000 muzzle diameters, and have an indefinite useful lifetime if properly maintained.

In the embodiment 100, the entrance and lobed nozzle 116 serve to control and reduce the static pressure of the gases exiting the muzzle while the vent holes 104 first dissipate the blast wave from the muzzle gases and thereafter ingest ambient air to purge, dilute and cool the residual gases. The ejector lobes assist and amplify the air ingestion process, stir the ingested air into the muzzle gases to enhancing their cooling and reduce the strength of the shock waves produced, which are further assisted by the convergent/divergent diffuser 127. Applicants believe the other disclosed embodiments will do the same.

The internal diameter of a suppressor housing 102 is between two and ten muzzle external diameters to accommodate the range of propellant gases used in the firearm. The "CUSPS" suppressor length is set between three and ten times its internal diameter to tailor its sound reduction to a desirable level.

FIG. 10 illustrates an alternate configuration, form the Parent Application, for the tubular housing 102 of "CUSPS" embodiment 100. The housing employs a non-circular cross-section.

The placement, number and size of the vent holes 104 are established to assure sufficient dilution of the muzzle gases to reduce flash and purging of the residual gases.

The entrance divergent nozzle's exit diameter and length are established using classic gas dynamic principals to produce isentropic, or near isentropic, expansion of the muzzle gases into the suppressor.

The exit nozzle diameter and length are established using classic gas dynamic principals to produce isentropic, or near isentropic, expansion of the muzzle gases out of the suppressor.

The mixer lobes, slots, tabs or swirl vanes have longitudinal, azimuthal and/or radial dimensions approximately equal to the radial dimensions of the entrance nozzle exit diameter and the suppressor internal diameter.

The ejector diameter is set between that of the entrance nozzle exit diameter and the suppressor internal diameter.

Each of the embodiments, from the Parent Application, can be thought of as a firearm suppressor comprising:

a. a suppressor housing, with vent holes; extending from the muzzle end of a firearm barrel; and
b. means for controlling and reducing the static pressure of muzzle gases exiting the muzzle of a discharged firearm while dissipating a blast wave from the muzzle gases and thereafter ingesting ambient air through the vent holes to purge, dilute and cool the residual gases.

Each of the "CUSPS" embodiments, from the Parent Application, also can be though of in method terms. For example, a method for firearms, and other guns, comprising:

a. attaching a suppressor onto the muzzle end of a firearm, whereby the suppressor is co-axial with a barrel of the firearm.
b. controlling and reducing the static pressure of muzzle gases exiting the muzzle of a discharged firearm, via the firearm suppressor, while dissipating a blast wave from the muzzle gases and thereafter ingesting ambient air through the vent holes to purge, dilute and cool the residual gases.

C-I-P Embodiments

FIGS. 11-15

During the continued development of the "CUSPS" firearm suppressor identified in the Parent Application, Applicants determined that certain modifications allowed a mixer/ejector to function effectively without outside vent holes. Their mixer nozzle in two new C-I-P embodiments (FIGS. 11-13, 14-15) ingests chamber air and contaminants, thus reducing the back pressure induced by the suppressor on the firearm system, without ingesting ambient air, while achieving high levels of noise and flash suppression. Such reduction is beneficial to both the firearm's mechanical operation and the ability for the mixer/ejector to purge harmful gases from the suppressor. The following describes in detail the novel geometry enhancements, which Applicants have tested and verified.

Concept Development: Most suppressors function by manipulating the pressure energy generated in the discharge of a bullet. Typically suppressors are designed with multiple chambers that temporarily "trap" the energy, and release it at a slower rate or convert it to a different form. As the high pressure, high temperature gasses moving with tremendous velocity are suddenly stopped by a baffle with a single tight opening, much of the gas changes direction and bounces around the chamber. This sudden change of direction takes energy away from the flow, and converts that energy into heat and strain on the suppressor. It also causes a sudden increase in pressure, as the flow is instantly restricted. Such sudden increase in pressure causes a high pressure wave to propagate backwards up the barrel length and to interfere with the proper operation of the firearms loading and firing mechanisms.

Applicants' preferred approach for reducing the back pressure level and effect is to keep the flow in the suppressor moving forward purging chamber contaminants and not bottled-up in the suppressor. For practical reasons, a suppressor is limited in length and volumes. In order to keep the flow moving, an alternate flow path for the gases has been incorporated. In Applicants' preferred and enhanced C-I-P embodiment 1000 (see FIGS. 11-13), the gases are allowed to continue forward movement to the exit by passing around depicted baffles. This generates an open, longer path for the mixing gases, thereby providing more opportunity to absorb energy and increase suppression.

As in the Parent Application, the internal diameter of Applicants' preferred "CUSPS" suppressor housing 1001 (see FIGS. 11 and 13) is again between two and ten muzzle external diameters to accommodate the range of propellant gases used in the firearm. The suppressor length can be set between three and ten times its internal diameter to tailor its sound reduction to a desirable level.

Unlike the embodiments disclosed in the Parent Application, Applicants' preferred C-I-P embodiment 1000 does not interact with any "outside" vent holes (i.e., throughbores perpendicular to the suppressor centerline or longitudinal axis 1005) along the length of the suppressor. In fact, Applicants' C-I-P embodiment 1000 does not need to have such vent holes in its suppressor housing 1001 for the system to work effectively. Future versions of the C-I-P preferred embodiment could use such vent holes for different requirements.

The concept, as depicted in FIG. 11, begins with an inlet slotted mixer nozzle 1002. The purpose of the mixer nozzle 1002 is to rapidly expand, entrain and mix the flow. The mixer nozzle 1002 causes the flow to expand out while it entrains and mixes with muzzle gas in a first chamber 1004.

A representative mixer nozzle 1002 (tested by Applicants) consists of three progressively increasing diameters of 0.230", 0.300", and 0.350". The first two diameters have square corners, and the last diameter has a slow taper. It is on this taper that the three equally spaced slots are cut. These cuts are approximately 0.250" wide and run about 0.750" from the tip of the nozzle. As the supersonic flow approaches the square corners, it is refracted away from the centerline 1005.

A preferred alternative mixer nozzle 1002 ends abruptly a quarter inch into the second diameter, utilizing the inner diameter of the suppressor as the third diameter in the progression. This alteration is only useful when the barrel will only be used in the suppressed configuration, as it will not prevent flash without the rest of the suppressor.

Immediately following the mixer nozzle 1002 is an expansion chamber 1004. In order to allow the gaseous flow to separate into multiple paths, it is necessary to allow the flow to expand away from the centerline 1005 (i.e., the longitudinal axis of the suppressor). Since the flow has axial momentum in the same direction as the projectile (e.g., bullet not shown), it will tend to remain close to the centerline. The mixer nozzle 1002 and the expansion chamber 1004 are designed to generate ejector action that accelerates outward expansion of the muzzle gases in order for the muzzle gases to rapidly mix with the chamber gases and then have a viable, alternate flow path to the exit. At this point the core of this design is introduced.

After the flow has expanded to fill the expansion chamber 1004, the first obstacle is introduced: a generally "wagon wheel" shaped blast baffle 1006. Its purpose is to immediately disrupt the mixer nozzle exit flow, without creating excessive amounts of back pressure. Its secondary purpose is to encourage the gas to not flow along the centerline 1005. Both of these goals are important because immediately following the blast baffle 1006 is a stack of alternating baffles 1012A, 1012B, 1012C, 1012D, 1012E, 1012F. This is where the flow is now given two paths: the straight path of the bullet or projectile and a longer winding path through open, lower resistance flow paths set up by the baffle flat sections shown in FIG. 11.

As best shown in FIGS. 12 and 13, the blast baffle 1006 is a generally circular disk with a plurality of discrete throughbores or outer passageways (e.g., 1008A, 1008B) equally spaced around and from a central vent hole 1010.

Dimensions of a representative blast baffle 1006, including its outer passageways (e.g., 1008A, 1008B) and central vent hole 1010, are as follows. The overall diameter of blast baffle 1006 is flush with the inner diameter of the suppressor; the blast baffle's center hole is 0.300"; and there are seven outer passageways, like 1008A and 1008B, which are evenly spaced trapezoids tangential to an inner diameter of 0.700" and have outer diameters of 1.250".

Following the blast baffle is a series of alternating, secondary baffles 1012A, 1012B, 1012C, 1012D, 1012E, 1012F. Looking at the cross-sectional side plan view of FIG. 11, baffles 1012A, 1012C, 1012E extend upwardly from the bottom of the suppressor, while; baffles 1012B, 1012D, 1012F extend outwardly. Otherwise, these secondary baffles preferably are identical. They resemble flat tires, with central vent holes and flat surfaces, beyond the holes. Dimensions of representative secondary baffles, including their vent holes, are as follows Tested representative secondary baffles consist of circular disks approximately 0.092" thick, with a 0.300" center hole, and a flat horizontal cut 0.500" from the center. They are spaced approximately 0.220" apart.

Live round testing utilizing the Mk16 assault rifle and M855 ammunition has determined that for a 5.56 caliber assault rifle, 5-7 alternating baffles has excellent performance. This is significant because too few baffles will not be effective at slowing the flow, and the suppressor will not be effective at suppressing noise or flash. If more than seven baffles are used, the additional noise suppression is minimal compared to the added length and weight. It is anticipated that different caliber weapons will have an optimal baffle stack both in number and spacing.

Following the baffle stack, comprising the blast baffle 1006 and alternate baffles 1012A-F, is a second expansion chamber 1014. Testing indicates that an expansion chamber 1014 following the baffle stack significantly improves the suppression capabilities. It is believed that this may increase the interference between the two flow paths, or possibly allow for less restriction along the alternate path.

The final feature of this design is the exit orifice or suppressor discharge 1016. Although the exit geometry is relatively commonplace, it has proven to be quite effective. The simple cylindrical exit protrudes into the chamber a moderate amount to limit the amount of flow exiting the suppressor. High velocity flow that is not on centerline will miss the exit opening, flow past the cylindrical protrusion, hit the back wall of the suppressor and bounce around the final chamber before it escapes into the ambient air.

A representative exit orifice 1016 is described as follows: a flat plate with a 0.500" diameter tube protruding 0.500" from the center. This protrusion has a 0.300" diameter hole through the center.

Figure 14:
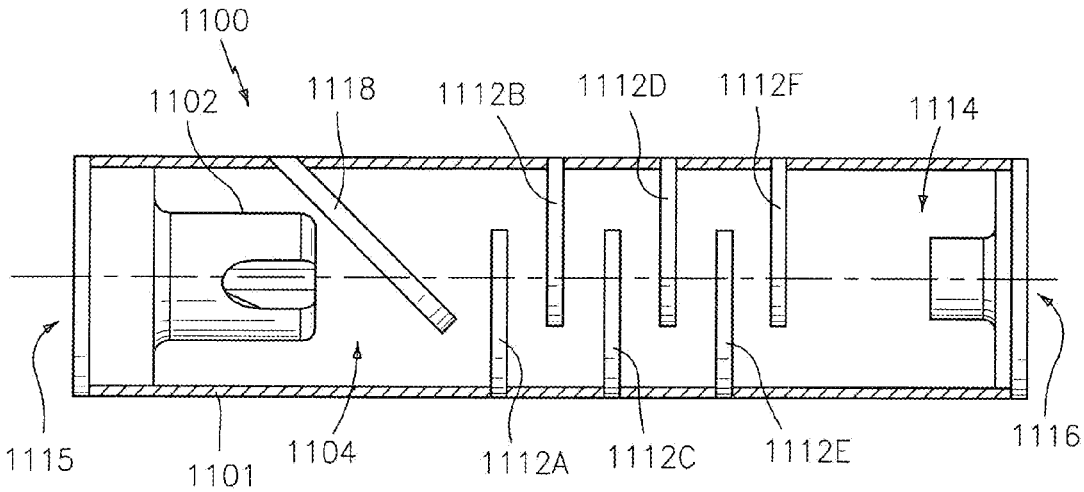
FIG. 14 is a plan view of an alternate C-I-P embodiment.
Figure 15:
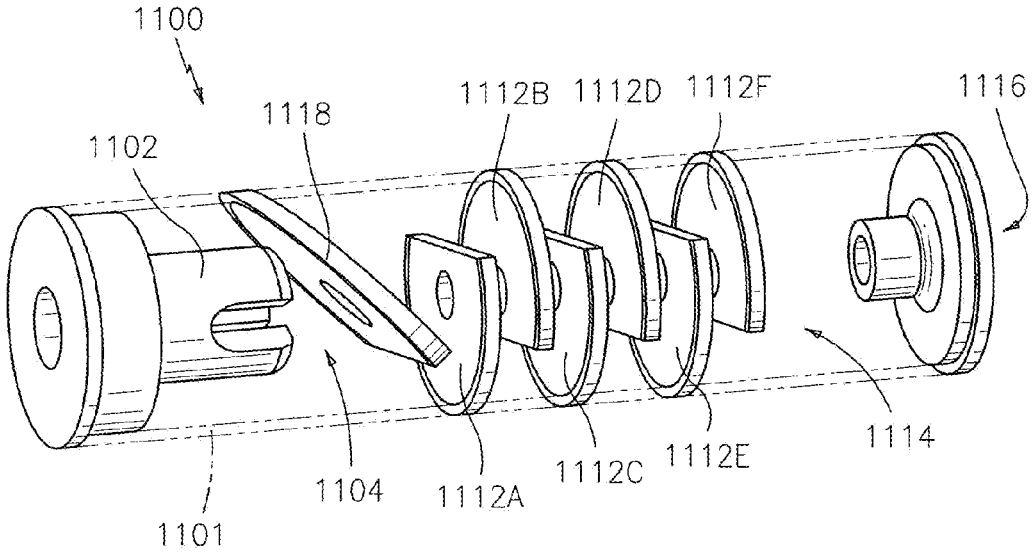
FIG. 15 is a plan view of the FIG. 13 embodiment.

FIGS. 14 and 15 show an alternate embodiment 1100 in which an angled blast baffle is used. Instead of a "wheel shaped" blast baffle 1006 being used, a larger version 1118 of one of the alternating baffles 1012A-F from the preferred embodiment 1000 has been substituted and angled. The baffle has been pitched forward at a preferred angle of 45 degrees, measured from the centerline of the suppressor.

FIGS. 14 and 15 depict elements like those found in the preferred embodiment 1000, shown in FIGS. 11-13, but reference them with the prefix 1100 rather than 1000. For example, the alternating baffles are referenced as 1112A, 1112B, 1112C, 1112D, 1112E, 1112F in FIGS. 14 and 15.

Both of these blast baffle configurations create an immediate disruption in the flow while allowing the gas to travel a path besides on centerline.

Field tests of the design shown in FIG. 11 verified high levels of noise and flash suppressor, while maintaining aiming accuracy with virtually no negative impact on the loading and firing mechanisms.

As in the parent Application, the entrance divergent nozzle's exit diameter and length (in the C-I-P embodiments) are established using classic gas dynamic principals to produce isentropic, or near isentropic, expansion of the muzzle gases into the suppressor.

The exit nozzle diameter and length are established using classic gas dynamic principals to produce isentropic, or near isentropic, expansion of the muzzle gases out of the suppressor.

The ejector diameter is set between that of the entrance nozzle exit diameter and the suppressor internal diameter.

Each of the C-I-P embodiments can be thought of as a firearm suppressor comprising:

a. a suppressor housing extending from the muzzle end of a firearm barrel, wherein the housing has a mid-length which extends between opposite ends of the housing and there are no vent holes along the mid-length; and b. suppressor means for controlling and reducing the static pressure of muzzle gases exiting the muzzle of a discharged firearm, without ingesting ambient air into the housing, while dissipating a blast wave from the muzzle gases to purge, dilute and cool the residual gases, wherein the suppressor means comprises the following sequential components within the housing:

i. a mixer nozzle, preferably slotted, having a discharge inside a chamber within the housing;

ii. a first expansion chamber;

iii. a blast baffle with a vent hole;

iv. a series of alternating baffles with substantially aligned vent holes;

v. a second expansion chamber; and vi. an exit orifice, at one end of the suppressor, for discharging the purged, diluted and cooled residual gases from the suppressor.

Instead of ingesting ambient air through outer vent holes (in the suppressor's outer or longitudinal wall) and mixing that air with the muzzle gases, as shown in the parent application, the preferred C-I-P embodiment ingests and mixes chamber gases and contaminants with the muzzle gases, and allows fluid flow through and out the suppressor. It too though can control or eliminate the Mach disk.

Each of the C-I-P embodiments also can be though of in method terms. For example, a method for firearms, and other guns, comprising:

a. attaching a suppressor, without any vent holes along its mid-length, onto the muzzle end of a firearm, whereby the suppressor is co-axial with a barrel of the firearm.

b. controlling and reducing the static pressure of muzzle gases exiting the muzzle of a discharged firearm, via a suppressor containing a mixer nozzle and baffles with throughbores, while dissipating a blast wave from the muzzle gases by ingesting and mixing chamber gases and contaminants with the muzzle gases, without ingesting any ambient air into the suppressor, to purge, dilute and cool the residual gases.

While all the embodiments (both the Parent and C-I-P) are detachable from a gun, they can be affixed, more permanently, to the barrel.

It should be understood by those skilled in the art that obvious structure modifications can be made about departing from the spirit or scope of the invention. For example, the same technique could be used for artillery or other guns.

We claim:

1. A suppressor for firearms comprising:

a. a suppressor housing, wherein the housing has a length which extends between opposite ends of the housing and there are no vent holes along the length; and b. the following sequential components inside the housing:

i. a slotted mixer nozzle at an inlet end of the suppressor, the slotted mixer nozzle having a plurality of slots, each slot having an upstream and downstream end, the downstream end of the slot being open;

ii. a first expansion chamber enclosing the slotted mixer nozzle;

iii. a blast baffle downstream from the first expansion chamber, wherein the blast baffle is a disk having a plurality of trapezoidal outer passageways equally spaced around and from a central vent hole;

iv. a series of alternating baffles with aligned central vent holes, each alternating baffle being a disk consisting of two flat sides, a central vent hole, and a flat surface spaced apart from the central vent hole and interrupting a circumference of the disk;

v. a second expansion chamber; and vi. an exit orifice at a discharge end of the suppressor.

2. The suppressor of claim 1, wherein the alternating baffles are perpendicular to a longitudinal axis of the suppressor housing.

3. The suppressor of claim 2 wherein successive alternating baffles are equally spaced apart, both longitudinally and radially, inside the tubular housing.

4. The suppressor of claim 1, wherein a longitudinal axis of the suppressor passes through all of the central vent holes of the blast baffle and the alternating baffles.

5. A firearm suppressor comprising:

a. a suppressor housing, wherein the housing has no vent openings, and the housing contains the following sequential components:

i. a slotted mixer nozzle at an inlet end of the housing, the slotted mixer nozzle having a plurality of slots, each slot having an upstream and downstream end, the downstream end of the slot being open;

ii. a blast baffle with a central vent hole, the blast baffle being angled at 45 degrees relative to a longitudinal axis of the suppressor housing;

iii. a first expansion chamber enclosing the blast baffle and mixer nozzle;

iv. a series of alternating baffles with aligned central vent holes, wherein the alternating baffles are perpendicular to the longitudinal axis of the suppressor housing, each alternating baffle being a disk consisting of two flat sides, a central vent hole extending perpendicularly to and joining the two flat sides, and a flat surface spaced apart from the central vent hole and interrupting a circumference of the disk;

v. a second expansion chamber; and vi. an exit orifice at a discharge end of the suppressor housing.

6. The suppressor of claim 5, wherein the longitudinal axis of the suppressor housing passes through all the central vent holes of the blast baffle and the alternating baffles.

7. The suppressor of claim 5, wherein successive alternating baffles are equally spaced apart, both longitudinally and radially, inside the tubular housing.

8. A firearm suppressor comprising a suppressor housing having an inlet end and a discharge end, wherein the housing contains in sequence:

a first expansion chamber;

a blast baffle with a central vent hole;

a series of secondary baffles, wherein each secondary baffle is a disk consisting of two flat sides, a central vent hole, and a flat surface spaced apart from the central vent hole and interrupting a circumference of the disk, the secondary baffles being perpendicular to a longitudinal axis of the suppressor;

a second expansion chamber; and an exit orifice at the discharge end, a cylindrical wall surrounding the exit orifice and protruding into the second expansion chamber.

9. The suppressor of claim 8, wherein the blast baffle is a disk having a plurality of trapezoidal outer passageways equally spaced around and from the central vent hole.

10. The suppressor of claim 8, wherein the blast baffle is canted relative to a longitudinal axis of the suppressor.

11. The suppressor of claim 10, wherein the blast baffle is a disk with a central vent hole and a flat surface spaced apart from the central vent hole that interrupts a circumference of the disk.

12. The suppressor of claim 10, wherein the blast baffle is canted 45 degrees relative to the longitudinal axis of the suppressor.

13. The suppressor of claim 8, wherein the secondary baffles are equally spaced apart longitudinally inside the housing.

14. The suppressor of claim 8, wherein the secondary baffles alternating extend from a bottom of the housing and a top of the housing.

15. The suppressor of claim 8, wherein a slotted mixer nozzle is located at the inlet end, the slotted mixer nozzle having a plurality of slots, each slot having an upstream and downstream end, the downstream end of the slot being open.

16. A firearm suppressor comprising a suppressor housing having an inlet end and a discharge end, wherein the housing contains in sequence:

a first expansion chamber;

a blast baffle, wherein the blast baffle is a disk with two flat sides, a central vent hole, and a flat surface interrupting a circumference of the disk, and wherein the blast baffle is canted relative to a longitudinal axis of the suppressor;

a series of secondary baffles, wherein each secondary baffle is a disk consisting of two flat sides, a central vent hole, and a flat surface spaced apart from the central vent hole and interrupting a circumference of the disk, and the flat surfaces being alternately located between one side and an opposite side of the housing, and the secondary baffles being perpendicular to a longitudinal axis of the suppressor;

a second expansion chamber; and an exit orifice at the discharge end.

* * * * *